United States Patent [19]

Goodson et al.

[11] Patent Number: 4,799,369

[45] Date of Patent: Jan. 24, 1989

[54] LOCK PROTECTOR

[76] Inventors: Thomas A. Goodson, 2717 NW. 157th St.; Ronald D. Truelove, 2713 NW. 157th St., both of Edmond, Okla. 73013

[21] Appl. No.: 79,885

[22] Filed: Jul. 30, 1987

[51] Int. Cl.[4] ..... E05B 67/38

[52] U.S. Cl. ..... 70/54; 70/56

[58] Field of Search ..... 70/14, 33, 54, 55, 56, 70/417, 418; 224/42.23, 42.25

[56] References Cited

U.S. PATENT DOCUMENTS

| | | | |
|---|---|---|---|
| Re. 29,643 | 5/1978 | Berry et al. | 70/52 |
| 2,541,638 | 2/1951 | Clevett | 70/56 |
| 3,004,057 | 5/1975 | Maurer | 70/54 |
| 3,475,931 | 11/1969 | Foote | 70/54 |
| 3,721,112 | 3/1973 | Wellekens | 70/39 |
| 3,783,657 | 1/1974 | Foote | 70/52 |
| 3,828,591 | 8/1974 | Beaver | 70/56 |
| 4,031,719 | 6/1977 | Klinger et al. | 70/56 |
| 4,033,155 | 7/1977 | De Lucia | 70/56 |
| 4,122,693 | 10/1978 | Barr | 70/56 |
| 4,141,232 | 2/1979 | Kelly | 70/54 |
| 4,238,941 | 12/1980 | Halopoff | 70/56 |
| 4,277,961 | 7/1981 | Williams | 70/54 |
| 4,282,995 | 8/1981 | Austin | 70/54 |
| 4,322,102 | 3/1982 | Lindblom | 292/281 |
| 4,506,528 | 3/1985 | Eberly | 70/54 |
| 4,548,058 | 10/1985 | Bahry | 70/56 |
| 4,555,920 | 12/1985 | Stanich | 70/54 |

FOREIGN PATENT DOCUMENTS

| | | | |
|---|---|---|---|
| 2169343 | 7/1986 | United Kingdom | 70/54 |

*Primary Examiner*—Robert L. Wolfe

*Attorney, Agent, or Firm*—Laney, Dougherty, Hessin & Beavers

[57] ABSTRACT

A lock protector for use with a padlock. The lock protector comprises a pair of spaced body members with a neck member extending therebetween and integrally formed therewith. The body members define a transverse slot therebetween for receiving a locking eye therein, and the body members are spaced such that a shackle of the padlock may be positioned therebetween and lockingly engaged with said locking eye, the transverse slot being substantially parallel to legs of the shackle. Skirts extend from each of the body members along sides of the padlock. The lock protector is particularly well adapted for use with a spare tire carrier on a motor vehicle.

23 Claims, 1 Drawing Sheet

LOCK PROTECTOR

BACKGROUND OF THE INVENTION

1. Field of the Invention

This invention relates to devices for protecting padlocks, and more particularly, to a lock protector having a locking eye receiving slot therein parallel to the legs of the lock shackle and adapted for preventing access to the shackle when lockingly engaged with the eye and a hasp, such as on the spare tire carrier of a motor vehicle.

2. Description of the Prior Art

A problem with locking an eye and hasp with a padlock is that the lock is exposed to tampering such as using a bolt cutter to cut a leg or legs of the shackle or by inserting a pry bar between the shackle and body such that the shackle may be forced open. In various efforts to obviate this problem, specialized padlocks and various protective devices have been developed.

One lock and protective guard assembly is disclosed in U.S. Pat. No. 3,783,657 to Foote which discloses a guard permanently attached to a lock body and having a transverse slot therethrough perpendicular to a leg of the lock shackle. This device provides reasonable protection to tampering of the shackle itself, but a tool could still possibly be inserted in the slot such that a lifting force could be applied to the guard and transmitted to the shackle for forcing the lock open. Another problem with this apparatus is that the guard must be assembled as part of the lock and is not adapted for fitting to standard locks.

The present invention solves the problems of the Foote apparatus in that a transverse slot is provided through the lock protector parallel to the legs of the shackle so that when the eye is in position and engaged with the shackle, it is extremely difficult to insert any sort of prying tool for forcing the lock open. Further, the lock protector of the present invention is specifically adapted for use with standard locks already on the market, and thus no special lock-guard combination is required.

SUMMARY OF THE INVENTION

The lock protector of the present invention comprises a pair of spaced body members adapted for receiving a shackle of a padlock therebetween, the body members defining aligned transverse slots therethrough parallel to legs of the shackle, and a neck member extending between the body members and between the legs of the shackle. Preferably, the body members and the neck member define a planar surface positionable adjacent a body of the padlock when the padlock is in a locked position, and the lock protector further comprises a skirt extending from at least one of the body members adjacent the planar surface and positionable adjacent the side of the body of the padlock.

The bottom surface of the transverse slots is spaced from the neck member.

The neck member is of substantially cylindrical configuration truncated parallel to a central axis thereof by the planar surface. The neck member defines an annular curvilinear groove in the portion thereof not truncated by the planar surface. The groove is substantially centrally positioned between the spaced body members.

In the preferred embodiment, the body members and the neck member are integrally formed from a hardenable material. Ferrous materials are preferred, such as hardenable ductile iron or steel.

The lock protector is designed for use with padlocks readily available in the market for protected locking engagement with locking eyes and hasps of a kind known in the art. One particular application is on a vehicle spare tire carrier of the type having a handle extending from a spare tire support and defining an opening therethrough, a bolt attached to a frame member extending through the opening, a lock nut threadingly engaged with the bolt and having a locking eye extending therefrom, a hasp with a slot therein engaged with the locking eye and extending through the opening and preventing rotation of the lock nut, and a padlock lockingly engaged with the locking eye.

An important object of the invention is to provide a lock protector for preventing tampering access to a shackle of a padlock.

Another object of the invention is to provide a lock protector having a locking eye receiving transverse slot therethrough wherein the slot is adapted to be substantially parallel to legs of a padlock shackle.

An additional object of the invention is to provide a lock protector having a pair of spaced body members defining a gap therebetween for receiving a padlock shackle and having a neck member extending between the body members and between legs of the shackle.

Still another object of the invention is to provide a lock protector having a planar surface positionable adjacent a body of a padlock and having skirts extending adjacent the planar surface for preventing access along sides of the body between the body and the planar surface.

Additional objects and advantages of the invention will become apparent as the following detailed description of the preferred embodiment is read in conjunction with the drawings which illustrate such preferred embodiment.

DETAILED DESCRIPTION OF THE PREFERRED EMBODIMENT

Figure 1:
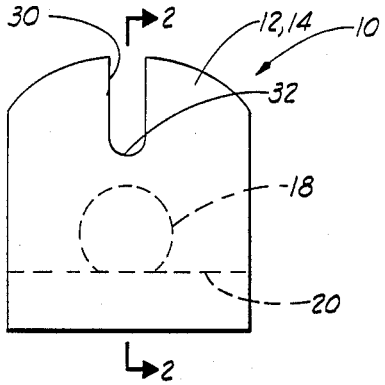
FIG. 1 shows a side elevation view of the lock protector of the present invention.
Figure 2:
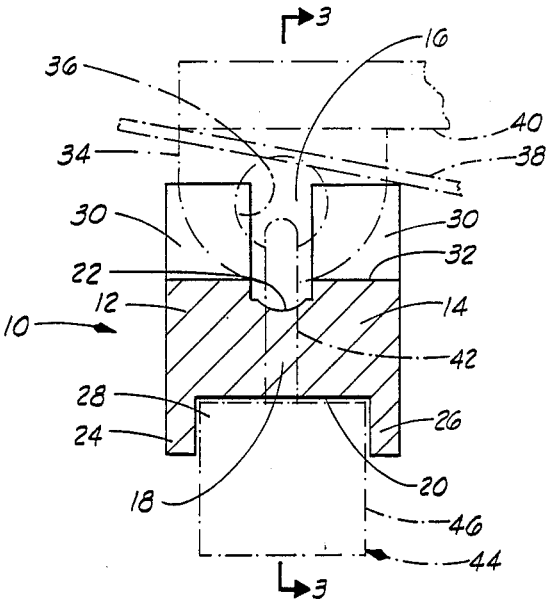
FIG. 2 shows a cross section taken along lines 2-2 in FIG. 1 and showing a locking eye and hasp disposed in the lock protector and engaged by a padlock.
Figure 3:
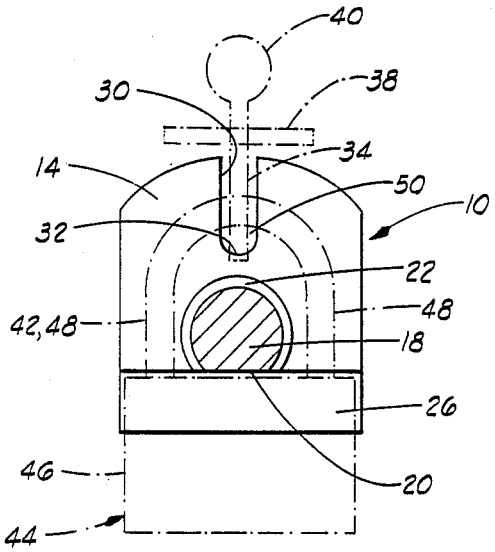
FIG. 3 is a cross section taken along lines 3-3 in FIG. 2.

Referring now to the drawings, and more particularly to FIGS. 1–3, the lock protector of the present invention is shown and generally designated by the numeral 10. Lock protector 10 comprises first and second body members 12 and 14 which are spaced such that a gap 16 is defined therebetween. A neck member 18 extends across gap 16 at one end thereof between first and second body members 12 and 14. Preferably, neck member 18 and first and second body members 12 and 14 are integrally formed by casting lock protector from a hardenable ferrous material, such as ductile iron or steel.

Neck member 18 and first and second body members 12 and 14 define a substantially planar surface 20 at one end thereof. As best seen in FIG. 3, neck member 18 forms a substantially cylindrical shape truncated parallel to its central axis by planar surface 20. A substantially annular curvilinear groove 22 is defined around the outer surface of neck member 18, except at the portion truncated by planar surface 20. Preferably, curvilinear groove 22 is substantially centrally disposed in gap 16 between first and second body members 12 and 14.

Extending adjacent planar surface 20 from first body member 12 in a direction opposite neck member 18 is a skirt 24. A similar skirt 26 extends from second body member 14. Skirts 24 and 26 are spaced apart and face one another such that a lock receiving gap 28 is defined therebetween.

First body member 12 and second body member 14 define aligned transverse grooves therethrough which may be referred to as a single transverse groove 30. A bottom end 32 of groove 30 is preferably spaced from neck portion 18 in a direction opposite planar portion 20, as clearly shown in FIGS. 1–3. It will be seen that transverse slot 30 is substantially perpendicular to gap 16 between first and second body members 12 and 14.

In operation, a locking eye 34 defining a hole 36 therethrough is disposed in transverse slot 30 through first and second body members 12 and 14. Previously positioned on locking eye 34 is a hasp 38 which is thus disposed between lock protector 10 and base 40 from which locking eye 34 extends. Locking eye 34 and hasp 38 are of any kind generally known in the art, and the invention is not intended to be limited to the particular configuration shown in FIGS. 2 and 3.

Once locking eye 34 is positioned in transverse slot 30, shackle 42 of a padlock 44 is positioned in gap 16 and around neck portion 18 of lock protector 10. Body 46 of padlock 44 is positioned adjacent planar surface 20 and such that rotation of the padlock about lock protector 10 is prevented. It will be seen that body 46 is between skirts 24 and 26 with opposite sides of the body adjacent the skirts. Lock protector 10 is dimensioned such that shackle 42 may be so positioned when the lock is in an extended, unlocked position, and may then be closed to the retracted, locked position shown in FIGS. 2 and 3.

It will be seen that access to shackle 42 by such devices as bolt cutters is prevented because the shackle is totally within gap 16 between first and second body members 12 and 14. Also, it will be noted that transverse slot 30 is oriented through body members 12 and 14 such that it is substantially parallel to legs 48 of shackle 42. As seen in FIG. 3, when locking eye 34 is positioned in transverse slot 30 and lockingly engaged by shackle 42 of packlock 44, only a very small aperture 50 remains. Aperture 50 is too small to insert a tool of sufficient strength such that shackle 42 could be pried away from body 46 to break lock 44.

Figure 4:
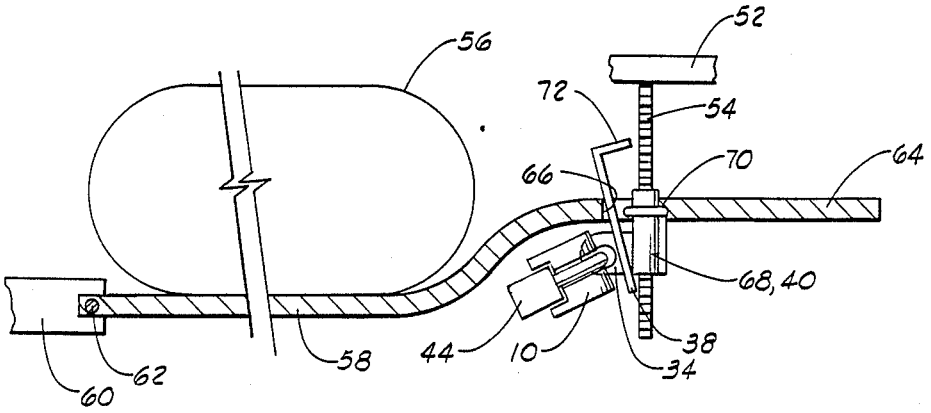
FIG. 4 shows a lock protector of the present invention in position with a padlock for protectedly locking a spare tire carrier on a motor vehicle.

Lock protector 10 is particularly well adapted for use in locking the spare tire carrier of a vehicle. As shown in FIG. 4, a typical vehicle, such as a Chevrolet, GMC or Ford pickup truck, includes a frame member 52 having a threaded bolt attached thereto and extending downwardly therefrom. A spare tire 56 is positioned on a support tray 58 which is hingedly attached to another frame member 60 at pivot point 62. Extending generally rearwardly on the vehicle is a handle 64 which is typically integrally formed with tray 58. Handle 64 defines an opening 66 therethrough. A lock nut 68 is threadedly engaged with bolt 54, and both lock nut and bolt are disposed through hole 66. Lock nut 68 supports handle 64, and thus tray 58, on shoulder 70. Lock nut 68 corresponds to base 40 with locking eye 34 extending into lock protector 10 in the manner hereinbefore described. A hasp 72 corresponding to hasp 38 is of substantially L-shaped configuration including a flange portion 74 thereon. Hasp 72 and opening 66 are dimensioned such that lock nut 68 and hasp 72 cannot be rotated on bolt 54 when assembled together as shown in FIG. 4. In other words, hasp 72 prevents rotation of lock nut 68 regardless of whether lock protector 10 and padlock 44 are in position. Of course, when lock protector 10 and padlock 44 are in position, hasp 72 cannot be disengaged from locking eye 34. Because of this, lock nut 68 cannot be unthreaded from bolt 54 and tray 58 cannot be lowered to obtain access to spare tire 56. Thus, lock protector 10 is particularly well adapted to protect a padlock 44 for locking the spare tire carrier of a motor vehicle. In addition to the previously known spare tire carrier described herein, lock protector 10 may be used with other similar devices.

It can be seen, therefore, that the lock protector of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A lock protector for a padlock, said lock protector comprising:

a pair of spaced body members adapted for receiving a shackle connected to said padlock therebetween, for preventing tampering access to said shackle, said body members defining aligned transverse slots therethrough parallel to legs of said shackle and adapted for receiving a locking eye therethrough engagable by said shackle; and a neck member integrally formed with said body members and extending between said body members and between said legs of said shackle.

2. The lock protector of claim 1 wherein said body members and said neck member define a planar surface positionable adjacent a body of said padlock when said padlock is in a locked position for preventing rotation of said padlock about said body members.

3. The lock protector of claim 2 further comprising a skirt extending from at least one of said body members adjacent said planar surface and positionable adjacent a side of said body of said padlock.

4. The lock protector of claim 1 wherein a bottom surface of said transverse slots is spaced from said neck member.

5. The lock protector of claim 1 wherein said neck member defines a curvilinear groove in a portion thereof.

6. The lock protector of claim 1 wherein said body members and said neck member are formed from a hardenable material.

7. The lock protector of claim 6 wherein said hardenable material is ductile iron.

8. A lock protector for use with a padlock of the type having a shackle thereon, said lock protector comprising:

a first body member having a planar end with a skirt extending from a side of said body member adjacent said end;

a second body member spaced from said first body member and having a planar end with a skirt extending from said second body member along a side thereof; and a neck member integrally formed with said first and second body members and extending therebetween adjacent said ends of said first and second body members;

wherein:

said first and second body members are adapted to receive said shackle of said padlock therebetween for preventing tampering access to said shackle such that said neck portion is disposed between the legs of said shackle and a body of said padlock is adjacent said planar ends of said first and second body members such that rotation of said padlock about said body members is prevented; and said first and second body members define a transverse slot therethrough substantially parallel to said legs of said shackle and adapted for receiving a locking eye therein engagable by said shackle, a bottom end of said slot being spaced from said neck portion.

9. The lock protector of claim 8 wherein said neck portion has a planar surface thereon aligned with said planar ends of said first and second body members.

10. The lock protector of claim 9 wherein said neck member has a substantially cylindrical outer surface truncated by said planar surface.

11. The lock protector of claim 10 wherein said cylindrical surface of said neck member defines a substantially annular curvilinear groove therein.

12. The lock protector of claim 11 wherein said groove is substantially centrally positioned between said first and second body members.

13. The lock protector of claim 9 wherein said first and second body members and said neck member are formed of a hardenable ductile iron material.

14. On a vehicle spare tire carrier of the type having a handle extending from a spare tire support and defining an opening therethrough, a bolt attached to a frame member extending through said opening, a lock nut threadingly engaged with said bolt and having a locking eye extending therefrom, a hasp with a slot therein engaged with said locking eye and extending through said opening for preventing rotation of said lock nut, and a padlock lockingly engaged with said locking eye, the improvement comprising:

a pair of substantially identical lock protector body portions positioned on opposite sides of a shackle of said padlock for preventing tampering access to said shackle, said body portions defining a transverse slot therethrough parallel to legs of said shackle and adapted for receiving said locking eye therethrough; and a lock protector neck portion extending between said lock protector body portions and between said legs of said shackle, wherein said body portions and said neck portion define a planar surface thereon adjacent a body of said padlock whereby rotation of said padlock about said body portions is prevented.

15. The apparatus of claim 14 further comprising a skirt on each of said body portions adjacent said planar surface, said skirts extending adjacent opposite sides of said padlock for preventing access between said body of said padlock and said planar surface and between said legs of said shackle.

16. The apparatus of claim 14 wherein a bottom end of said transverse slot is spaced from said neck portion on a side thereof opposite said planar surface.

17. The apparatus of claim 14 wherein said body portions and said neck portion are integrally cast of a hardenable ferrous material.

18. A lock protector for preventing tampering access to a shackle of a padlock on a vehicle spare tire carrier of the type having a handle extending from a spare tire support and defining an opening therethrough, a bolt attached to a frame member extending through said opening, a lock nut threadingly engaged with said bolt and having a locking eye extending therefrom, and a hasp with a slot therein engaged with said locking eye and extending through said opening for preventing rotation of said lock nut, said padlock being lockingly engaged with said locking eye, said lock protector comprising:

first and second lock protector bodies positioned on opposite sides of said shackle for preventing tampering access thereto, said bodies defining a transverse slot therethrough substantially parallel to legs of said shackle and adapted for receiving said locking eye therethrough; and a lock protector neck portion extending between said first and second bodies and between said legs of said shackle, wherein said first and second bodies and said neck portion define a planar surface thereon adjacent a body of said padlock for preventing rotation of said padlock about said first and second bodies.

19. The lock protector of claim 18 further comprising a skirt on each of said first and second bodies adjacent said planar surface, said skirts extending adjacent opposite sides of said padlock for preventing access between said body of said padlock and said planar surface and between said legs of said shackle.

20. The lock protector of claim 18 wherein a bottom end of said transverse slot is spaced from said neck portion on a side thereof opposite said planar surface.

21. The lock protector of claim 18 wherein said first and second bodies and said neck member are integrally formed.

22. The lock protector of claim 21 wherein said first and second bodies and said neck member are cast of a hardenable ferrous material.

23. The lock protector of claim 18 wherein said neck member defines a curvilinear groove and a portion thereof substantially centrally positioned between said first and second bodies.

* * * * *